US007571760B2

(12) United States Patent
Lee et al.

(10) Patent No.: US 7,571,760 B2
(45) Date of Patent: Aug. 11, 2009

(54) CONDENSER OF REFRIGERATOR

(75) Inventors: Jang-seok Lee, Incheon (KR); Kyeong-yun Kim, Seoul (KR); Sung Jhee, Gyeonggi-do (KR); Nam-soo Cho, Seoul (KR); Kyong-bae Park, Seoul (KR)

(73) Assignee: LG Electronics Inc., Seoul (KR)

( * ) Notice: Subject to any disclaimer, the term of this patent is extended or adjusted under 35 U.S.C. 154(b) by 474 days.

(21) Appl. No.: 10/569,422

(22) PCT Filed: Nov. 26, 2004

(86) PCT No.: PCT/KR2004/003091

§ 371 (c)(1),
(2), (4) Date: Feb. 23, 2006

(87) PCT Pub. No.: WO2006/009339

PCT Pub. Date: Jan. 26, 2006

(65) Prior Publication Data

US 2008/0164016 A1 Jul. 10, 2008

(30) Foreign Application Priority Data

Jul. 23, 2004 (KR) ..... 10-2004-0057771
Nov. 25, 2004 (KR) ..... 10-2004-0097603

(51) Int. Cl.
*F28D 1/00* (2006.01)
*F28D 1/04* (2006.01)
*F25B 39/04* (2006.01)

(52) U.S. Cl. ..... 165/150; 165/151

(58) Field of Classification Search ..... 165/150, 165/151, 177; 62/507, 526
See application file for complete search history.

(56) References Cited

U.S. PATENT DOCUMENTS 2,021,117 A * 11/1935 Lucke ..... 165/157
2,316,284 A * 4/1943 Ploeger ..... 62/507
2,322,341 A * 6/1943 Booth ..... 165/131
2,354,131 A * 7/1944 Larkin ..... 165/68
2,437,452 A * 3/1948 Baird ..... 165/135
3,780,799 A * 12/1973 Pasternak ..... 165/150

(Continued)

FOREIGN PATENT DOCUMENTS

JP 54-46065 3/1979

(Continued)

OTHER PUBLICATIONS

English language Abstract Korean 2001-0073641.

(Continued)

*Primary Examiner*—Tho v Duong
(74) *Attorney, Agent, or Firm*—Birch, Stewart, Kolasch & Birch, LLP

(57) ABSTRACT

A condenser for a refrigerator includes an inline arrangement in which a refrigerant tube is arranged such that refrigerant tube parts are arranged in lines in the forward and backward direction, and a staggered arrangement in which the refrigerant tube parts are arranged at the rear side of the inline arrangement in the forward and backward direction to misaligned with each other, such that the difference of air flow between a front side and a rear side thereof is minimized when heat exchange with ambient air in the condenser is performed by blowing operation of a cooling fan installed to a side of the condenser.

16 Claims, 15 Drawing Sheets

U.S. PATENT DOCUMENTS

| | | | | |
|---|---|---|---|---|
| 5,219,023 | A * | 6/1993 | Kadle | 165/110 |
| 2004/0040699 | A1 | 3/2004 | Lee | |
| 2005/0044882 | A1 | 3/2005 | Hong et al. | |
| 2005/0150241 | A1 * | 7/2005 | Upton et al. | 62/240 |

FOREIGN PATENT DOCUMENTS

| | | |
|---|---|---|
| KR | 10 0244206 | 11/1999 |
| KR | 2000 0008536 | 5/2000 |
| KR | 2001 0073641 | 8/2001 |

OTHER PUBLICATIONS

English language Abstract Korean 10-0244206.

* cited by examiner

PRIOR ART

PRIOR ART

PRIOR ART

Fig.7

[Table 1]

| Sample (10 rows, 8 lyaers) | S1(mm) | S2(mm) | Q(W) | △P(pa) | $Q/(\triangle P)^{1/3}$ |
|---|---|---|---|---|---|
| 1 | 8 | 6 | 92.3 | 14.8 | 37.6 |
| 2 | 8 | 9 | 92.3 | 13.9 | 38.9 |
| 3 | 8 | 12 | 93.4 | 13.6 | 38.8 |
| 4 | 11 | 6 | 92.4 | 9.2 | 47.4 |
| 5 | 11 | 9 | 99.4 | 9.1 | 46.9 |
| 6 | 11 | 12 | 97.8 | 8.8 | 43.7 |
| 7 | 14 | 6 | 90.2 | 9.0 | 46.0 |
| 8 | 14 | 9 | 95.7 | 8.5 | 46.3 |
| 9 | 14 | 12 | 94.6 | 8.4 | 42.9 |
| 10 | 16 | 6 | 87.6 | 10.5 | 39.3 |
| 11 | 16 | 9 | 86.2 | 8.8 | 40.0 |
| 12 | 16 | 12 | 78.9 | 8.4 | 38.3 |

Fig.11

[Table 2]

| Sample (10 rows, 8 lyaers) | No.of Inline Tubes | No.of Staggered Tubes | Q | △P | $Q/(\triangle P)^{1/3}$ |
|---|---|---|---|---|---|
| 1 | 0(0%) | 10(100%) | 99.4 | 9.2 | 47.4 |
| 2 | 3(30%) | 7(70%) | 103.2 | 9.1 | 49.5 |
| 3 | 5(50%) | 5(50%) | 106.4 | 8.9 | 51.4 |
| 4 | 7(70%) | 3(30%) | 102.3 | 8.5 | 50.2 |
| 5 | 10(100%) | 0(0%) | 95.4 | 8.3 | 47.0 |

Fig.13

[Table 3]

| Items | | Sample Spec | | |
|---|---|---|---|---|
| Refrigerator | | #2 | #3 | #4 |
| Refrigerating Perfomance (Refrigerating Speed) | F-compartment | 82.3min | 79.6min | 81.4min |
| | R-compartment | 84.2min | 81.5min | 83.4min |
| Refrigerating Perfomance (Refrigerating ability) | F-compartment | -27.8℃ | -28.4℃ | -28.0℃ |
| | R-compartment | -19.5℃ | -20.1℃ | -19.7℃ |
| Power Consumption | | 44.12 | 42.40 | 43.34 |

CONDENSER OF REFRIGERATOR

BACKGROUND OF THE INVENTION

1. Field of the Invention

The present invention relates to a condenser for a refrigerator, and more particularly, to a condenser for a refrigerator for minimizing the difference of air flow rate between a front side and a rear side thereof when heat exchange with ambient air in the condenser is performed by blowing operation of a cooling fan installed to a side of the condenser.

2. Description of the Related Art

Generally, a refrigerator is an apparatus for freezing and refrigerating food in a freezing compartment and a refrigerating compartment by changing phase of refrigerant according to a refrigerant cycle of compression, condensation, expansion, and evaporation, and its structure is depicted in FIG. 1.

FIG. 1 is a vertical elevation view schematically illustrating the structure of a general refrigerator. As shown in FIG. 1, the refrigerator includes a main body 1 divided into a freezer compartment 3 and a refrigerator compartment 4 by a partition 2 disposed between the freezer compartment 3 and the refrigerator compartment 4, a freezer compartment door 3*a* and a refrigerator door 4*a* respectively hinged to the front sides of the freezer compartment 3 and the refrigerator compartment 4, a heat exchanging chamber 5 including an evaporator 6 and a blower fan 7 and disposed at the rear side of the freezer compartment 3.

Moreover, the partition 2 is formed with a freezer return duct 21 and a refrigerator return duct 22, for respectively returning chilled air in the freezer compartment 3 and the refrigerator compartment 4 to the heat exchanging chamber 5. A chilled air duct 8 is formed at the rear side of the refrigerator compartment 4 to communicate with the freezer compartment 3 and has a plurality of chilled air discharge ports 8*a*. A machine room M is formed at the rear lower side of the main body 1 to accommodate a compressor 9 and a condenser (not shown).

Air in the freezer compartment 3 and the refrigerator compartment 4 is sucked into the heat exchanging chamber 5 by the blower fan 7 of the heat exchanging chamber 5 through the freezer return duct 21 and the refrigerator return duct 22 formed in the partition 2 to undergo heat-exchange in the evaporator 6, and is discharged into the freezer compartment 3 and the refrigerator compartment 4 through the chilled air discharge ports 8*a* of the chilled air duct 8, and this cycle is repeated. At that time, frost is attacked to the surfaces of the evaporator 6 due to the temperature difference between ambient air and the air circulating in the freezer compartment 3 and the refrigerator compartment 4 re-introduced into the evaporator via the freezer compartment return duct 21 and the refrigerator return duct 22.

In order to defrost, the evaporator 6 includes a defrost heater 10 at the lower side thereof, and defrosting water generated when the frost is defrosted is collected in a defrosting water vessel (not shown) provided at the lower side of the main body 1 via a defrosting water discharge pipe 11.

The machine room M, as shown in FIG. 2, is provided with the compressor 9 for changing a low-temperature-and-low-pressure gaseous refrigerant into a high-temperature-and-high-pressure gaseous refrigerant, a condenser 12 for condensing the high-temperature-and-high-pressure gaseous refrigerant into a room-temperature-and-high-pressure liquid refrigerant by performing heat-exchange between the high-temperature-and-high-pressure gaseous refrigerant generated by the compressor 9 and ambient air, and a cooling fan 13 for blowing the introduced ambient air in the machine room M to the condenser 12.

Generally, the condenser 12, as shown in FIG. 3, has a wire-on-tube structure such that straight tube parts are parallel to each other, "U"-shaped tube parts are connected to the straight tube parts in zigzag fashion to form a serpentine shaped refrigerant tube 121 and to have multiple layers, and wire radiator fins 122 with a small circular cross-section are placed on the serpentine shaped refrigerant tube 121 and welded thereto by spot-welding.

In the conventional condenser 12, in order to increase contact surface between ambient air blown by the cooling fan 13 and the refrigerant tube 121, as shown in FIG. 2, the refrigerant tube 121 has a staggered arrangement formed from the front side facing the cooling fan 13 to the rear side thereof. In other words, the straight tube parts and the "U"-shaped tube parts of the refrigerant tube 121 are misaligned with the same in other layers.

Thus, due to narrow distance between the straight tube parts of the refrigerant tube 121 in the same layer, since air pneumatic resistance is increased when ambient air blown by the cooling fan 13 passes through the condenser 12, there is a difference of flow rate of ambient air between the front side and the rear side of the condenser 12 ambient air passing through the condenser 12, and thus cooling efficiency of the condenser 12 deteriorates and power consumption thereof is increased. Thus, economic value and reliability of the refrigerator are deteriorated.

SUMMARY OF THE INVENTION

Therefore, the present invention has been made in view of the above and/or other problems, and it is an object of the present invention to provide a condenser for a refrigerator in which a cooling fan is installed at a side thereof and difference between flow rates at the front side and the rear side of the condenser is minimized when refrigerant in the condenser is heat-exchanged with ambient air by blowing operation of the cooling fan.

It is another object of the present invention to provide a condenser for a refrigerator for minimizing difference between flow rates and increasing heat-transferring surface.

In accordance with the present invention, the above and other objects can be accomplished by a provision of a condenser including: an inline arrangement in which a refrigerant tube is arranged such that refrigerant tube parts are arranged in lines in the forward and backward direction; and a staggered arrangement in which the refrigerant tube parts are arranged at the rear side of the inline arrangement in the forward and backward direction to misaligned with to each other; and wherein the ratio of the inline arrangement with respect to the staggered arrangement ranges from 50% to 60%, distance (S1) between the refrigerant tube parts in a row direction ranges from 10 mm to 15 mm, a distance (S2) between the refrigerant tube parts ranges from 5 mm to 10 mm.

Preferably, the ratio of the inline arrangement to the staggered arrangement is 50%, the distance (S1) between the refrigerant tube parts in the row direction is 11 mm, and the distance (S2) between the refrigerant tube parts is 6 mm.

The refrigerant tube has radiator fins and is bent in the zigzag fashion to have multiple layers.

The radiator fins have a screw shape and are integrally formed with the outer circumference of the refrigerant tube.

The refrigerant tube is constructed such that extruded refrigerant tube parts are straightened by plastic deformation using rollers, the radiator fins are formed on the outer circumference of the refrigerant tube by cutting the outer circumference of the refrigerant tube, and the refrigerant tube formed with the radiator fins is bent in the serpentine shape in multiple layers.

The radiator fins are symmetrically formed on the outer circumference of the refrigerant tube and have a plurality of louvers penetrating the radiator fins in the vertical direction.

The louvers have a rectangular shape.

The radiator fins are made of aluminum plates having penetrating holes formed at a central portion thereof and are fixed around the outer circumference of the refrigerant tube at regular intervals.

BRIEF DESCRIPTION OF THE DRAWINGS

The object and advantages of the present invention will become apparent and more readily appreciated from the following description of an embodiment, taken in conjunction with the accompanying drawings, in which:

FIG. 7 is a table obtained from a first experiment performed in the present invention;

FIG. 11 is Table 2 obtained from a second experiment performed in the present invention;

FIG. 13 is Table 3 obtained from a third experiment performed in the present invention;

DESCRIPTION OF THE PREFERRED EMBODIMENTS

Hereinafter, a condenser for a refrigerator according to the preferred embodiment of the present invention will be described in detail with reference to the accompanying drawings.

Figure 1:
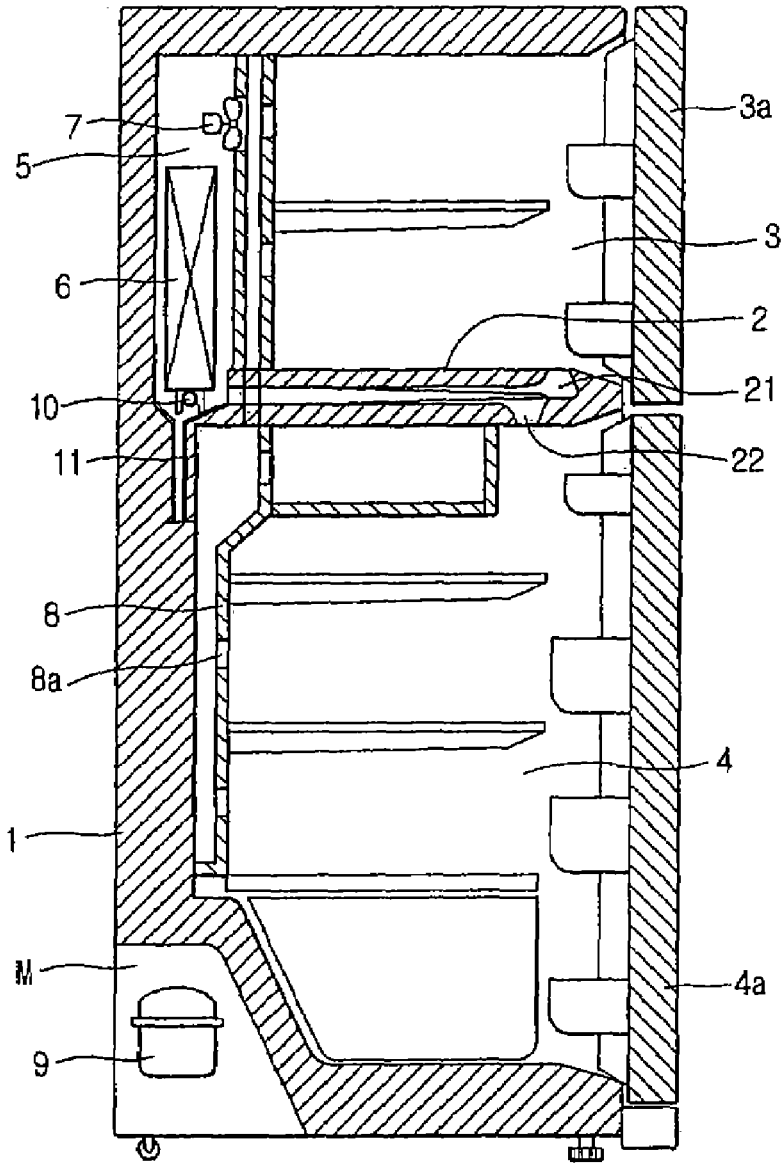
FIG. 1 is a schematic vertical sectional view illustrating the structure of a conventional refrigerator.
Figure 2:
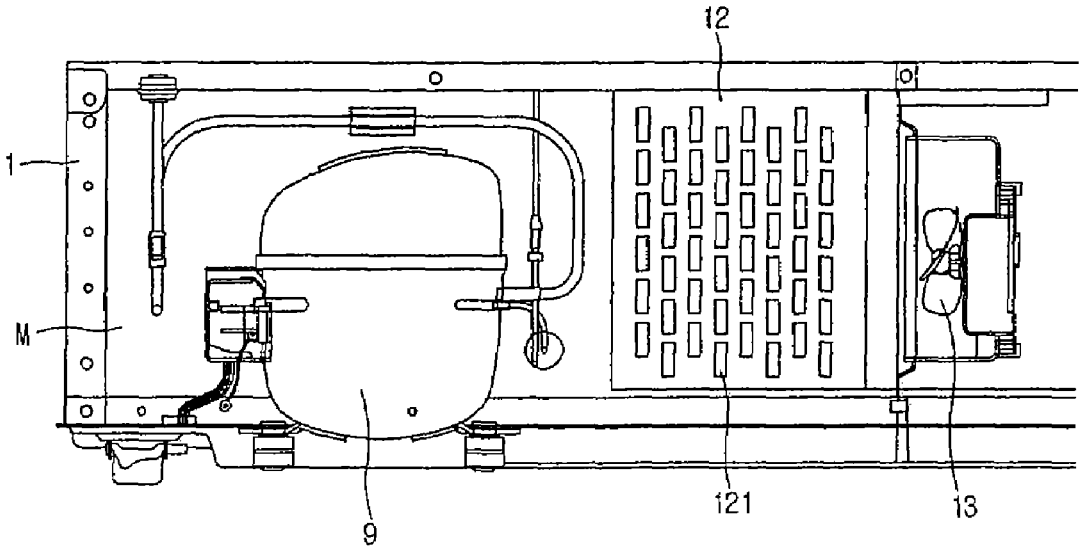
FIG. 2 is a partially enlarged rear side view illustrating a machine room of the conventional refrigerator.
Figure 3:
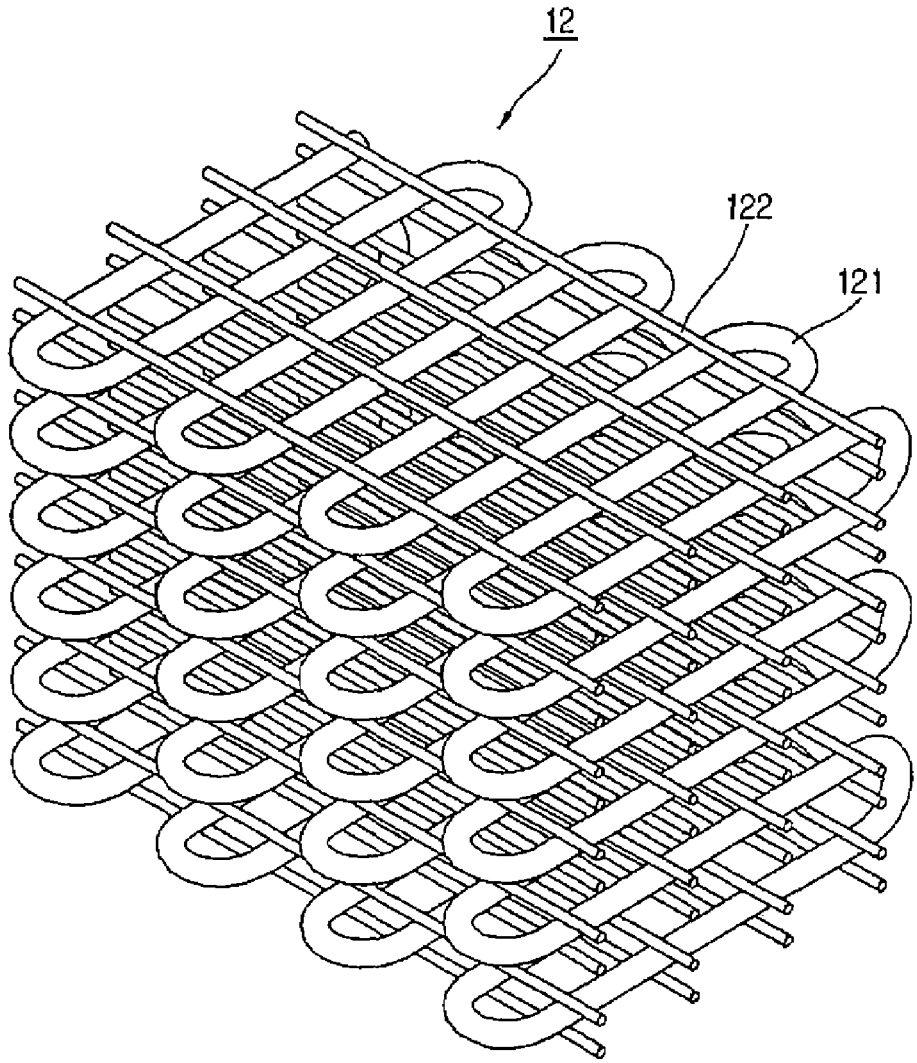
FIG. 3 is a perspective views illustrating the structure of a conventional condenser.
Figure 4:
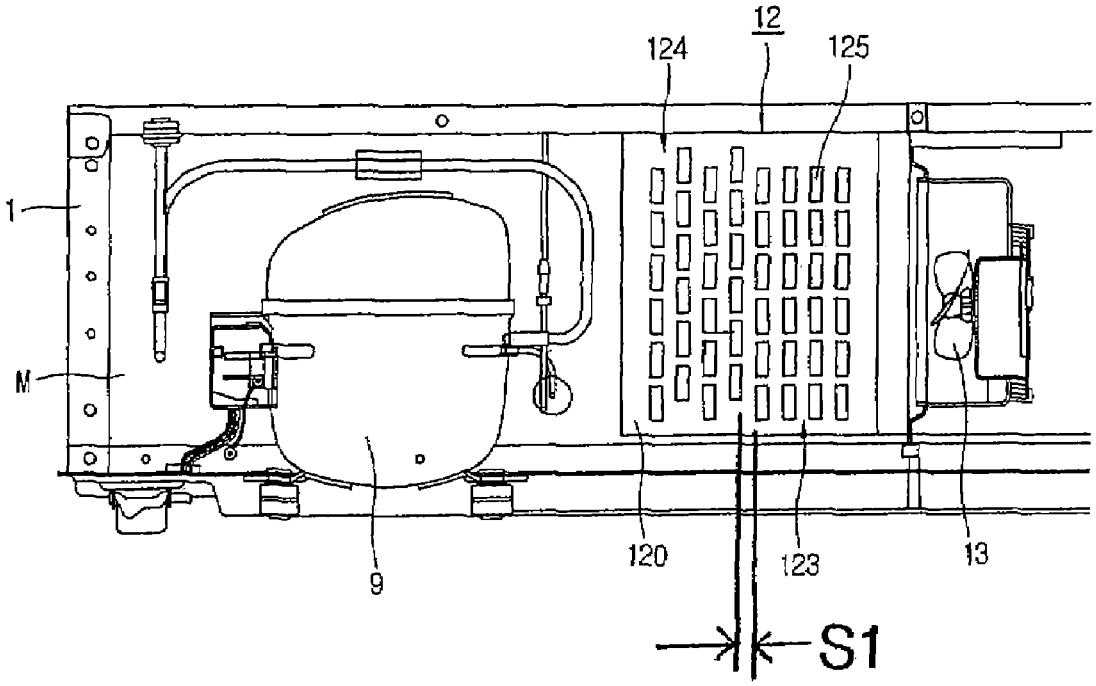
FIG. 4 is a partially enlarged rear side view illustrating the structure of a machine room of a refrigerator employing a condenser according to a preferred embodiment of the present invention.

FIG. 4 is a rear side view illustrating the structure of a machine room of a refrigerator employing a condenser according to a preferred embodiment of the present invention.

Generally, the machine room of a refrigerator is provided with a compressor 9 for changing a low-temperature-and-low-pressure gaseous refrigerant into a high-temperature-and-high-pressure gaseous refrigerant, a condenser 12 for condensing the high-temperature-and-high-pressure gaseous refrigerant into a room-temperature-and-high-pressure liquid refrigerant by performing heat-exchange between the high-temperature-and-high-pressure gaseous refrigerant generated by the compressor 9 with ambient air, and a cooling fan 13 for blowing the introduced ambient air in the machine room M to the condenser 12.

In such a refrigerator, according to the preferred embodiment of the present invention, the condenser 12 is structured such that difference between flow rates at the front side of the condenser 12 facing the cooling fan 13 and the rear side of the condenser 12 is minimized. To this end, the condenser 12 includes an inline arrangement 123 provided at the front side of the condenser 12 and a staggered arrangement 124 provided at the rear side of the condenser 12.

The inline arrangement 123 is structured such that straight tube parts of a refrigerant tube 121 are parallel to each other, "U"-shaped tube parts of the refrigerant pipe 121 are connected to the straight tube parts in zigzag fashion to have multiple layers, and the straight tube parts and the "U"-shaped tube parts are aligned with other tube parts in vertical and horizontal directions. The stagger arrangement 124 is structured such that, like the conventional condenser, the straight tube parts and the "U"-shaped tube parts of the refrigerant pipe 121 are misaligned with the same in other layers in the horizontal direction.

Meanwhile, the staggered arrangement of the conventional condenser 12 serves to increase contact area between ambient air blown by the cooling fan 13 and the refrigerant tube 121. When the inline arrangement 123 is provided at the front side of the condenser 121 as in the present invention, flow rate of ambient air may be increased due to decrease of the air pneumatic resistance. However, the increase of the contact area between the refrigerant pipe 121 and ambient air may not be expected.

Figure 5:
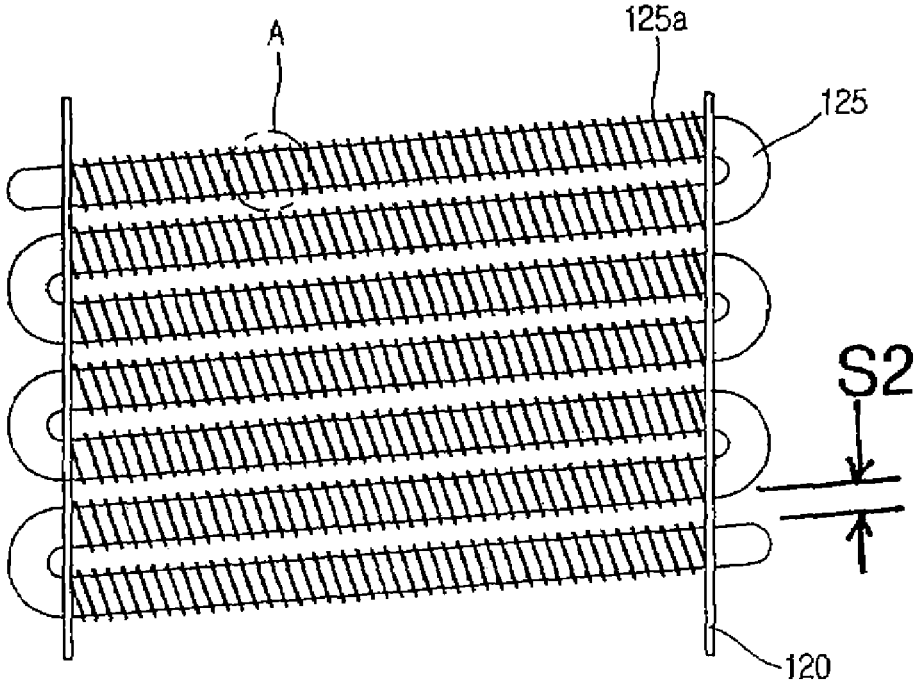
FIG. 5 is a front view illustrating a refrigerant tube according to a first embodiment of the present invention.

However, the condenser 12 according to the preferred embodiment of the present invention is characterized in that difference between air flow rates at the front side and the rear side of the condenser 12 is minimized and the heat-transferring area of the condenser is increased. To solve the decrease of the contact area between the condenser 12 and ambient air, the refrigerant tube 121 of the present invention, as shown in FIG. 5, is structured in the form of a refrigerant tube 125 of a screw-type heat exchanger.

Figure 6:
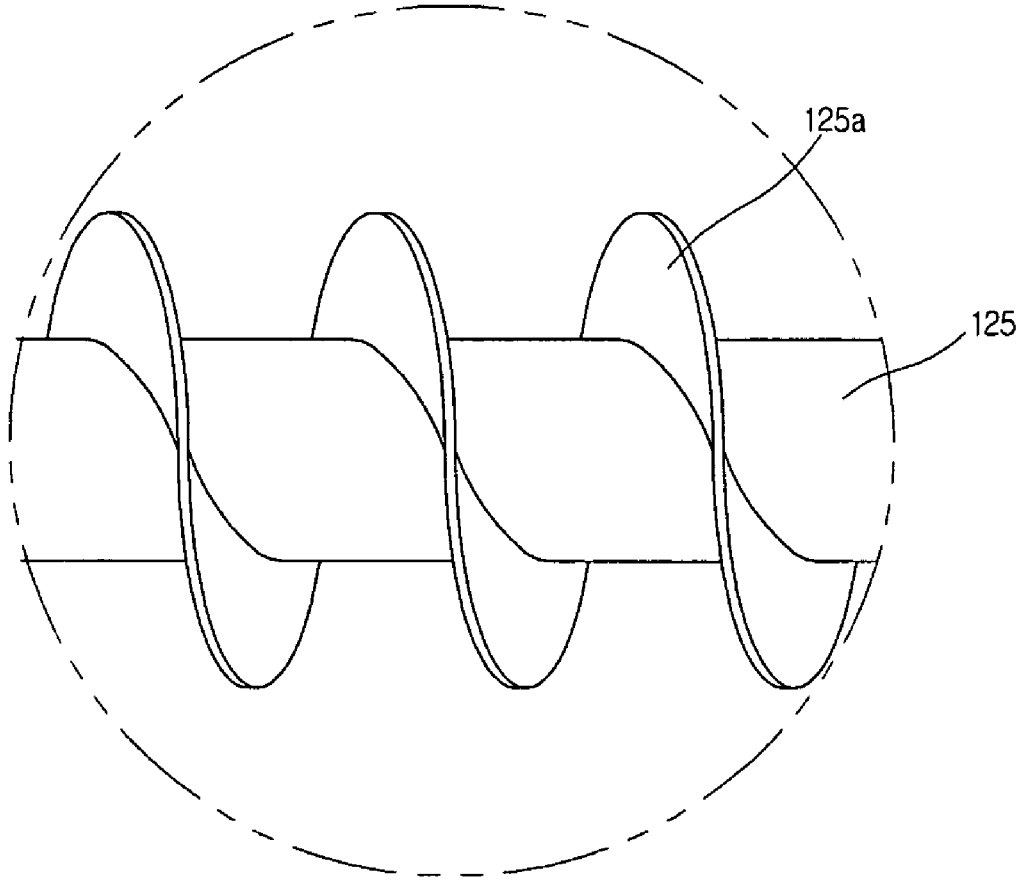
FIG. 6 is an enlarged view of portion "A" in FIG. 5.
Figure 8:
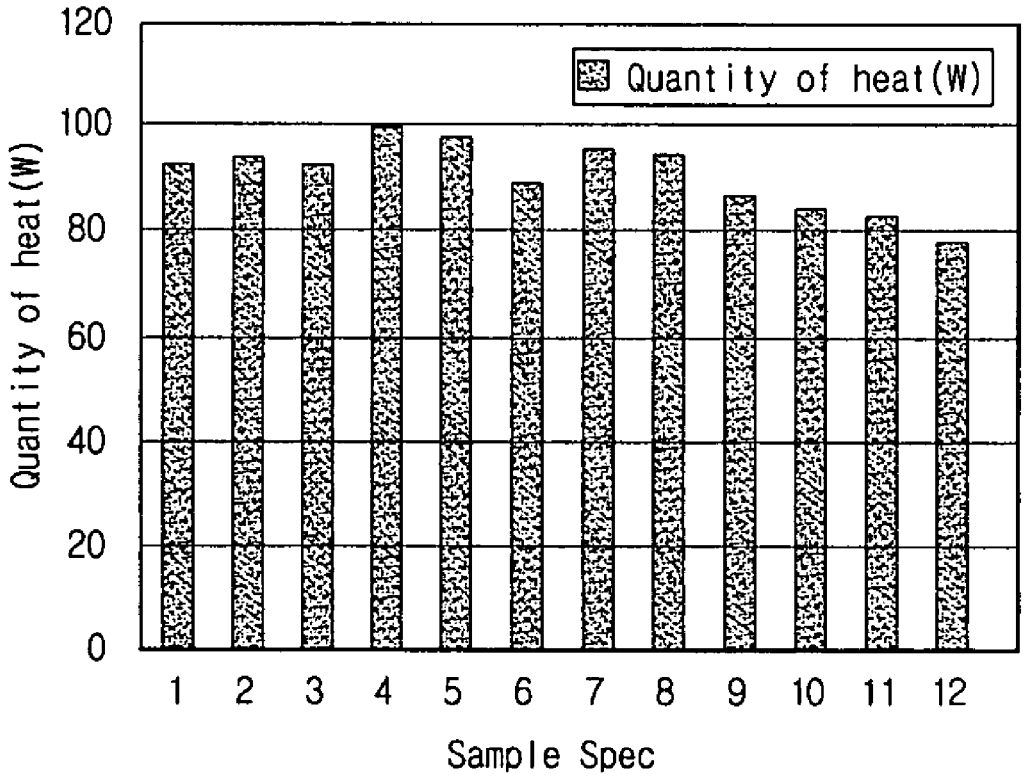
FIG. 8 is a graph illustrating quantity of heat in FIG. 7.
Figure 9:
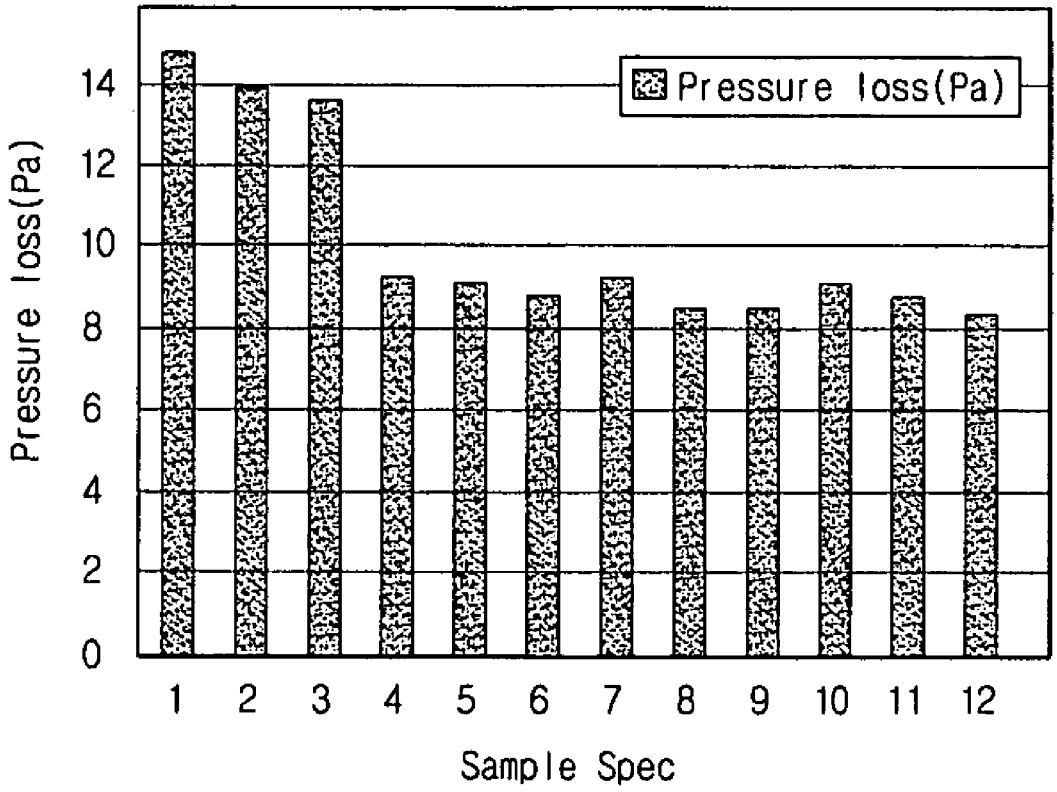
FIG. 9 is a graph illustrating pressure loss in FIG. 7.

The screw-type heat exchanger, as shown in FIG. 6, includes screw-shaped radiator fins 125*a* formed in the outer circumference of the refrigerant tube 121, and the refrigerant tube 125 formed with the radiator fins 125 is bent in the serpentine shape in multiple layers.

Reference numeral 120 is assigned to supports for supporting sides of the refrigerant tube 125.

As described above, the condenser 12 of a refrigerator according to the preferred embodiment of the present invention includes the front side of the condenser 12 having the inline arrangement 123, the rear side thereof having the staggered arrangement 124 such that the difference between air flow rates at the front side and the rear side of the condenser 12 is minimized due to the decrease of the air pneumatic resistance. Moreover, the refrigerant tube 125 including the inline arrangement 123 and the staggered arrangement 124 is manufactured as a refrigerant tube in which the screw-shaped radiator fins 125*a* are formed on the outer circumference of the refrigerant tube 125 such that the heat-transferring area of the condenser 12 is increased and cooling performance of the condenser 12 is also increased.

By doing so, when the condenser 12 according to the preferred embodiment of the present invention is compared with the conventional wire-on-tube condenser in terms of surface area, the condenser 12 according to the preferred embodiment of the present invention exhibits cooling performance equal to or greater than the cooling performance of the conventional condenser even when the condenser 12 has a surface area corresponding to 70% of the surface area of the conventional condenser.

A heat exchanger used in the condenser must be designed taking sufficient consideration of heat-transferring performance and distance between tube parts, while the heat-transferring performance and performance of the condenser depends on the distance between the tube parts.

Generally, when the distance between the tube parts is increased, air pneumatic resistance due to the tube parts is decreased so that air pressure loss due to the tube parts is reduced. On the other hand, when the distance between the tube parts is decreased, air pneumatic resistance due to the tube parts is increased so that air pressure loss is increased. Thus, the heat-transferring efficiency and performance of the condenser are deteriorated.

Therefore, since the heat-transferring performance and performance of the heat exchanger used in the condenser are determined according to the distance between the tube parts, optimal distance between the tube parts and optimal arrangement of the tube parts should be optimally determined when designing the condenser.

In order to determine optimal conditions for the condenser as described above, the applicant of the present invention has performed heat-transferring experiments according to variations of the distance between tube parts as follows, and as a result, has determined the optimal conditions.

<Experiment 1>

In this experiment, the heat-transferring performance of the condenser according to distance S1 between the tube parts in the horizontal direction and distance S2 between the tube parts in the vertical direction was measured, and experimental conditions were substantially identical to conditions when the condenser is applied to a refrigerator. Described in detail, condensing temperature was 37 degrees centigrade (9.5 $Kg/cm^2$), inlet port temperature of the condenser was 65 degrees centigrade, flow rate of the refrigerant was 3.8 Kg/h, and airflow rate was 1.0 CMM.

As heat exchangers as samples to be measured have 10 rows, 8 layers, the distances S1 of 8, 11, 14, and 16 mm, and the distance S2 of 6, 9, and 12 mm, respectively. The measurements were performed 12 times. The heat exchanger is not restricted to 10 rows and 8 layers and may the number of layers and rows may be modified freely. The tube parts of the condenser are arranged in the staggered arrangement.

According to Table 1 of FIG. 7, a sample No. 1 of the heat exchangers is measured under the conditions S1=8 mm and S2=6 mm, and exhibited quantity of heat (Q(W)) of 92.3, air pressure loss (ΔP(pa)) of 14.8, resulting in heat-transferring performance $(Q/(\Delta P)^{1/3})$ of 37.6.

On the other hand, a sample No. 4 of the heat exchangers was measured under the conditions S1=11 mm and S2=6 mm, and exhibited quantity of heat (Q(W)) of 99.4, air pressure loss (ΔP(pa)) of 9.2, resulting in heat-transferring performance $(Q/(\Delta P)^{1/3})$of 47.4. Thus, difference between the sample No. 1 and sample No. 4 in view of heat-transferring performance is 9.8.

In other words, although sample No. 4 has S1, that is, the distance between tube parts, greater than that of sample No. 1, sample No. 4 exhibits better heat-transferring performance than the heat-transferring performance of the sample No. 1.

Figure 10:
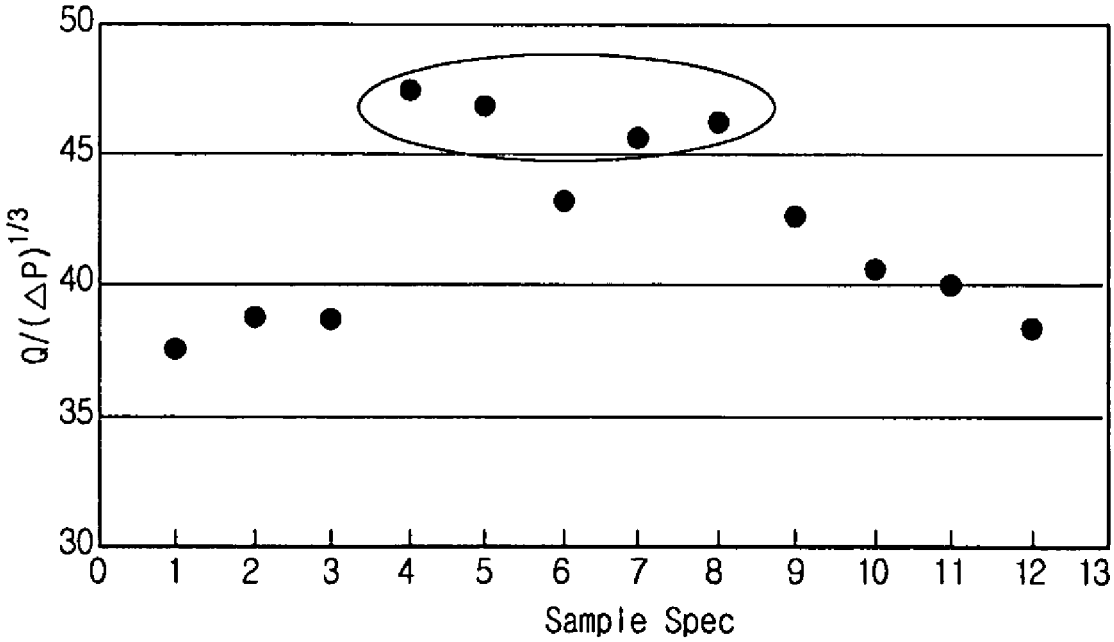
FIG. 10 is a graph illustrating heat-transferring performance of a condenser performed in the first experiment of the present invention.

According to the experiment results, the heat-transferring performance is increased as the quantity of heat is increased, in particularly, sample Nos. 4, 5, 7, 8 exhibit the highest heat-transferring performance (See FIG. 10).

In other words, the sample No. 4, under the conditions of S1=11 mm and S2=6 mm, exhibited quantity of heat (Q(W)) of 99.4, air pressure loss (ΔP(pa)) of 9.2, resulting in the highest heat-transferring performance $(Q/(\Delta P)^{1/3})$ of 47.4, and sample No. 5 under the conditions of S1=11 mm and S2=9 mm, exhibited the next highest heat-transferring performance of 46.9, and sample No. 8 and sample No. 7, in turn.

Thus, it is understood that the condenser exhibits excellent heat-transferring performance under the conditions S1=10 to 15 mm and S2=5 to 10 mm, in particularly, the highest heat-transferring performance under the conditions of S1=11 mm and S2=6 mm.

<Experiment 2>

In this experiment, quantity of heat of the heat exchanger according to ratio of the staggered arrangement and the inline arrangement of the tube parts was performed five times by changing the arrangement of the tube parts of the sample exhibiting the highest heat-transferring performance under the conditions of S1=11 mm and S2=6 mm, and a heat exchanger having 10 rows and 8 layers was used.

According to Table 2 in FIG. 10, when the ratio of the number of tube parts in the inline arrangement to that of the staggered arrangement is 0:10, that is, when the heat exchanger had only staggered arrangement of the tube parts, the heat exchanger exhibited quantity of heat (Q(W)) of 99.4, air pressure loss (ΔP(pa)) of 9.2, resulting in heat-transferring performance $(Q/(\Delta P)^{1/3})$of 47.4.

When the ratio of the number of tube parts in the inline arrangement to that of the staggered arrangement was 3:7, that is, when the heat exchanger had 30% inline arrangement and 70% staggered arrangement of the tube parts, the heat exchanger exhibited quantity of heat (Q(W)) of 103.2, air pressure loss (ΔP(pa)) of 9.1, resulting in heat-transferring performance $(Q/(\Delta P)^{1/3})$ of 49.5. Thus, it can be understood that the heat-transferring performance is improved by about 2.1 in comparison to the case of the heat exchanger having only staggered arrangement of tube parts. When the inline arrangement of tube parts was increased to 50%, the heat-transferring performance of the heat exchanger was improved by about 1.9.

However, when the inline arrangement of tube parts was increased more than 70% as in sample Nos. 4 and 5 in Table 2, the heat exchanger exhibited the heat-transferring performance improved by 1.2 and 4.4 in comparison to the case of the heat exchanger having 50% inline arrangement of tube parts.

Figure 12:
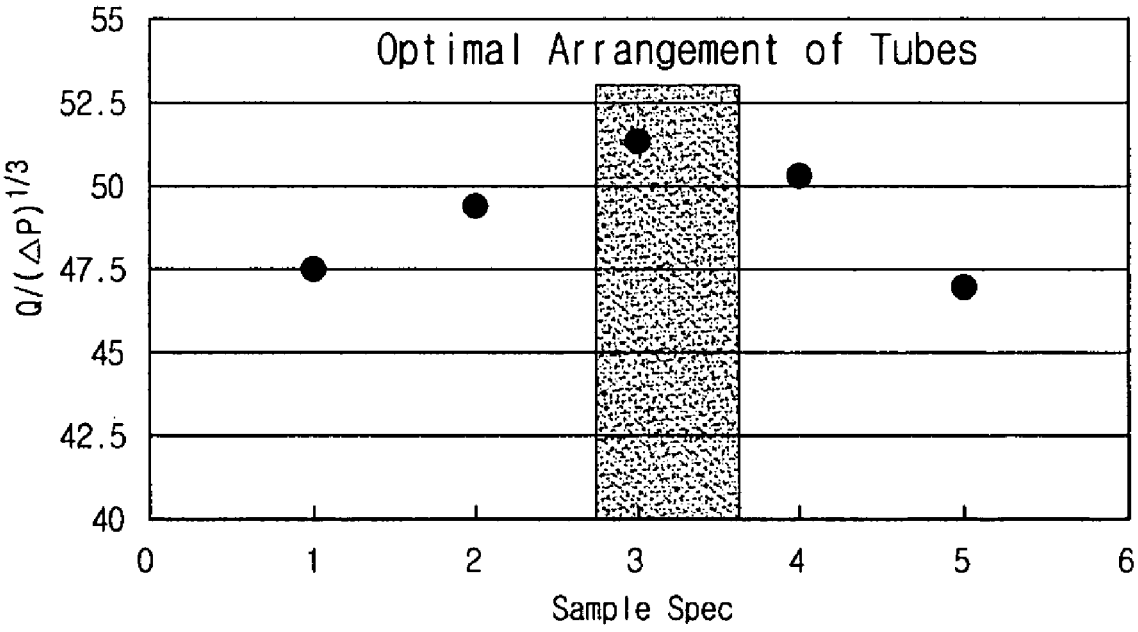
FIG. 12 is a graph illustrating heat-transferring performance of a condenser performed in the second experiment of the present invention.

Therefore, the heat exchanger having 50% inline arrangement of tube parts exhibited the highest heat-transferring performance, the heat exchanger having 70% inline arrangement of tube parts exhibited a secondary higher heat-transferring performance, and the heat exchanger having 30% inline arrangement of tube parts exhibited a thirdly higher heat-transferring performance. In other words, it is understood that the heat exchanger provided with 50% to 60% inline arrangement of tube parts at the front side of the condenser exhibits optimal heat-transferring performance (See FIG. 12).

<Experiment 3>

In this experiment, refrigerating performance and power consumption of a refrigerator according to the ratio of the staggered arrangement and the inline arrangement were measured, and it is understood that the ratio influences refrigerating speed and refrigerating ability of a refrigerator and the power consumption of the refrigerator due to the same.

According to Table 3 in FIG. 13, a sample No. 3 under the conditions of 50% inline arrangement of tube parts exhibited the highest refrigerating speed in the freezer compartment (F-compartment) and the refrigerator compartment (R-compartment), the highest refrigerating performance due to the refrigerating ability, and the lowest power consumption.

Thus, when the condenser is designed such that the ratio of the inline arrangement of tube parts to the staggered arrangement of tube parts is 50% to 60%, S1 (the distance between tube parts in the row direction) is 10 mm to 15 mm, and S2 (the distance of tube parts in the vertical direction) is 5 mm to 10 mm, the condenser exhibits the highest heat-transferring performance, and preferably, the condenser exhibits the optimal heat-transferring efficiency and performance when the ratio of the inline arrangement is 50%, S1=11 mm, and S2=6 mm.

Figure 14:
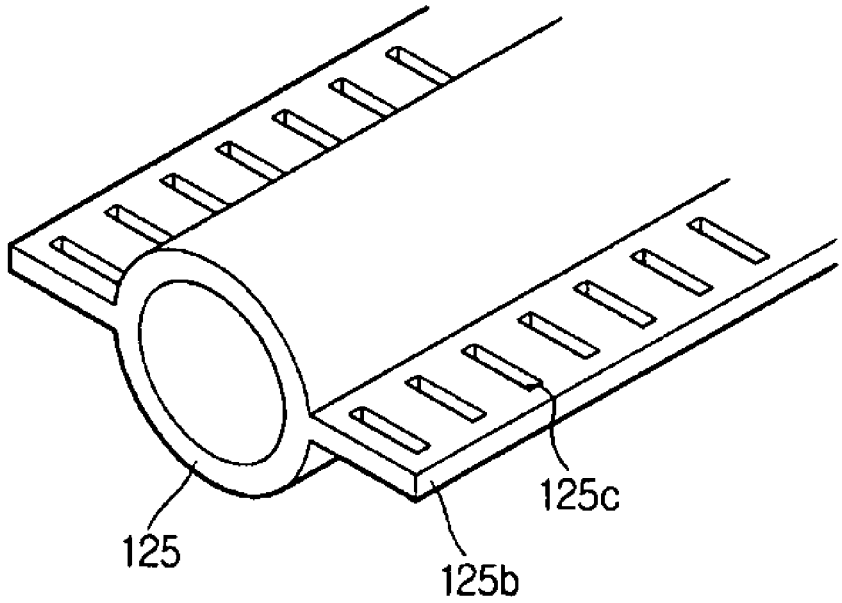
FIG. 14 is a perspective view illustrating a refrigerant tube of a condenser according to a second preferred embodiment of the present invention.

The structure of the radiator fins of the condenser according to the preferred embodiment of the present invention, as described above, has the screw-shape and can be changed into the structure shown in FIGS. 13 and 14. The radiator fins 125*b* are integrally formed with the outer circumference of the refrigerant tube 125 to be symmetrically arranged to each other and have a plurality of louvers penetrating the radiator fins 125*b* in the vertical direction.

Figure 15:
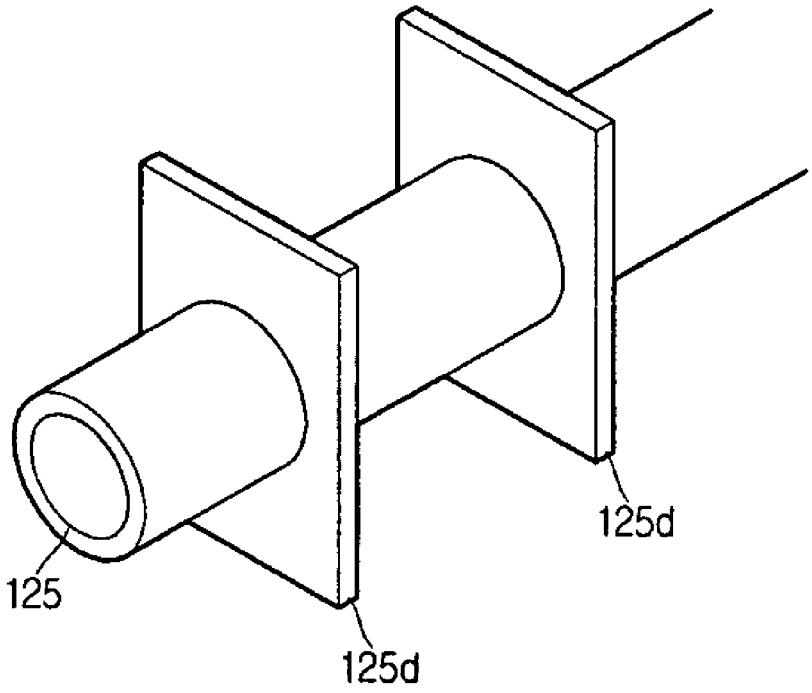
FIG. 15 is a perspective view illustrating a refrigerant tube of a condenser according to a third preferred embodiment of the present invention.

The radiator fins 125*d*, as shown in FIG. 15, are made of aluminum plates to be fixed on the outer circumference of the refrigerant tube 125 at regular intervals, like the general fin-pipe type heat exchanger. The radiator fins 125*b* are applied to the heat exchanger of the condenser by considering the heat-transferring efficiency, the intervals and arrangements of the tube parts, and more particularly, the radiator fins 125*b* satisfy the conditions such that the ratio of the inline arrangement of the tube parts to the staggered arrangement of the tube parts is set to 50% to 60%, S1 (the distance of the tube parts in the row direction) is set to 10 mm to 15 mm, and S2 (the distance of the tube parts in the vertical direction) is set to 5 mm to 10 mm.

As described above, according to the condenser for a refrigerator in accordance with the present invention, since the difference between air flow rates at the front side and the rear side of the condenser is minimized when the heat exchange of the condenser with ambient air is performed by the blowing operation of the cooling fan installed to a side of the condenser, condensing efficiency of the condenser is improved and power consumption thereof is reduced so that reliability and economic utility of the condenser are enhanced.

The difference between air flow rates in the condenser is minimized and the refrigerant tube is provided with radiator fins such as screw-shaped radiator fins such that heat-transferring area is increased to guarantee sufficient heat-transferring area, so that heat-transferring efficiency and refrigerating performance of the condenser are enhanced due to sufficient heat-transferring area.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A condenser comprising:

an inline arrangement in which a refrigerant tube is arranged such that refrigerant tube parts are arranged in lines in the forward and backward direction; and a staggered arrangement in which the refrigerant tube parts are arranged at the rear side of the inline arrangement in the forward and backward direction to misaligned with to each other; and wherein the ratio of the inline arrangement with respect to the staggered arrangement ranges from 50% to 60%, a distance between the refrigerant tube parts in a row direction ranges from 10 mm to 15 mm, a distance between the refrigerant tube parts in a vertical direction ranges from 5 mm to 10 mm.

2. The condenser as set forth in claim 1, wherein the ratio of the inline arrangement to the staggered arrangement is 50%, the distance between the refrigerant tube parts in the row direction is 11 mm, and the distance between the refrigerant tube parts in a vertical direction is 6 mm.

3. The condenser as set forth in claim 1, wherein the refrigerant tube has radiator fins and is bent in the zigzag fashion to have multiple layers.

4. The condenser as set forth in claims 3, wherein the radiator fins have a screw shape and are integrally formed with the outer circumference of the refrigerant tube.

5. The condenser as set forth in claim 4, wherein the refrigerant tube is constructed such that extruded refrigerant tube parts are straightened by plastic deformation using rollers, the radiator fins are formed on the outer circumference of the refrigerant tube by cutting the outer circumference of the refrigerant tube, and the refrigerant tube formed with the radiator fins is bent in the serpentine shape in multiple layers.

6. The condenser as set forth in claim 3, wherein the radiator fins are symmetrically formed on the outer circumference of the refrigerant tube and have a plurality of louvers penetrating the radiator fins in the vertical direction.

7. The condenser as set forth in claim 6, wherein the louvers have a rectangular shape.

8. The condenser as set forth in claim 3, wherein the radiator fins are made of aluminum plates having penetrating holes formed at a central portion thereof and are fixed around the outer circumference of the refrigerant tube at regular intervals.

9. A refrigerator comprising:

a condenser including:

an inline arrangement in which a refrigerant tube is arranged such that refrigerant tube parts are arranged in lines in the forward and backward direction; and a stagger arrangement in which the refrigerant tube parts are arranged at the rear side of the inline arrangement in the forward and backward direction to be misaligned with each other; and wherein the ratio of the inline arrangement to the staggered arrangement ranges from 50% to 60%, a distance between the refrigerant tube parts in a row direction ranges from 10 mm to 15 mm, and a distance between the refrigerant tube parts in a vertical direction ranges from 5 mm to 10 mm.

10. The refrigerator as set forth in claim 9, wherein the ratio of the inline arrangement to the staggered arrangement is 50%, the distance between the refrigerant tube parts in the row direction is 11 mm, and the distance between the refrigerant tube parts in the vertical direction is 6 mm.

11. The refrigerator as set forth in claim 9, wherein the refrigerant tube has radiator fins and is bent in the zigzag fashion to have multiple layers.

12. The refrigerator as set forth in claim 11, wherein the radiator fins have a screw shape and are integrally formed with the outer circumference of the refrigerant tube.

13. The refrigerator as set forth in claim 12, wherein the refrigerant tube is constructed such that extruded refrigerant tube parts are straightened by plastic deformation using rollers, the radiator fins are formed on the outer circumference of the refrigerant tube by cutting the outer circumference of the refrigerant tube, and the refrigerant tube formed with the radiator fins is bent in the serpentine shape in multiple layers.

14. The refrigerator as set forth in claim 11, wherein the radiator fins are symmetrically formed on the outer circumference of the refrigerant tube and have a plurality of louvers penetrating the radiator fins in the vertical direction.

15. The refrigerator as set forth in claim 14, wherein the louvers have a rectangular shape.

16. The refrigerator as set forth in claim 13, wherein the radiator fins are made of aluminum plates having penetrating holes formed at a central portion thereof and are fixed around the outer circumference of the refrigerant tube at regular intervals.

* * * * *